United States Patent [19]

Irvine et al.

[11] Patent Number: 4,566,685

[45] Date of Patent: Jan. 28, 1986

[54] DOCUMENT FEEDING DEVICE

[75] Inventors: Robert Irvine, Riverside; Frank T. Roetter, Westport; Willis R. Stearns, Darien, all of Conn.

[73] Assignee: Pitney Bowes Inc., Stamford, Conn.

[21] Appl. No.: 577,000

[22] Filed: Feb. 6, 1984

[51] Int. Cl.[4] ..... B65H 1/02

[52] U.S. Cl. ..... 271/150; 271/31; 271/31.1; 271/126; 271/152; 271/155

[58] Field of Search ..... 271/149, 150, 152–156, 271/30 A, 129, 126, 121, 124, 125, 31, 31.1

[56] References Cited

U.S. PATENT DOCUMENTS

| | | | |
|---|---|---|---|
| 2,163,145 | 6/1939 | Johnson | 271/150 |
| 3,047,290 | 7/1962 | Thomsen | 271/125 |
| 3,580,567 | 5/1971 | Hashimoto | 271/154 |

OTHER PUBLICATIONS

IBM Technical Disclosure Bulletin, "Horizontal Timing Belt Driven Feed Hopper" by Diel et al., vol. 13, No. 2, Jul. 1970, pp. 438 & 439.

*Primary Examiner*—Bruce H. Stoner, Jr.
*Assistant Examiner*—John A. Carroll
*Attorney, Agent, or Firm*—Lawrence E. Sklar; William D. Soltow, Jr.; Albert W. Scribner

[57] ABSTRACT

A document feeding device having a hopper oriented at an acute angle with respect to a horizontal plane, the hopper having an upstream aperture and a downstream aperture and able to support a pack of documents to be fed therefrom, a device situated at the lower end of the hopper for feeding documents seriatim from the hopper, a first pulley whose outer surface extends slightly through the downstream aperture and a second pulley whose outer surface extends slightly through the upstream aperture, and a double sided timing belt mounted on the first and second pulleys and riding on the upper surface of the hopper. The document feeding device also includes a switch in contact with the lead document of the pack of documents, the switch having contacts which close when the angle of repose of the pack of documents relative to the hopper is sufficiently decreased, and a solenoid operatively connected to one of the pulleys and to the switch, wherein when the contacts are closed, the solenoid is energized to index the one pulley, whereby the timing belt is indexed forward, thereby moving the pack of documents forward and maintaining the pack of documents at an optimum pack pressure and angle of repose for seriatim feeding.

5 Claims, 2 Drawing Figures

DOCUMENT FEEDING DEVICE

BACKGROUND OF THE INVENTION

The instant invention relates to a document feeding device, and more particularly to a device for maintaining paper documents being fed seriatim from a hopper at their optimum pack pressure and angle for separation and feeding.

Inserting machines typically include a plurality of feeding devices which feed documents from a pack of documents situated in a hopper seriatim to a transport deck therebelow, from which a collated packet of documents are eventually inserted into an envelope. The inserter document feeders employ hoppers that generally are inclined at a fixed angle which usually is somewhere between about 20 and 30 degrees. The feeder depends on gravity to slide the documents down to and against a separator roller and stone. The nature of this system is such that it is virtually impossible to maintain an ideal pack pressure and pack angle in the documents throughout the hopper's full capacity. A full hopper creates too high a pack pressure and angle while a near empty hopper creates too low a pack pressure and angle. The nature of the material being fed may also contribute to the difficulty of maintaining the optimum pack pressure and angle depending upon whether the material is glossy or rough (finish), or whether it is curled, twisted, spongy, thick or heavy.

The foregoing problems of maintaining optimum pack pressure and angle in a pack of documents to be fed from a document feeder hopper are overcome by the instant invention which maintains the ideal pack pressure and angle regardless of the number of documents loaded into the hopper or any of the characteristics of the documents.

SUMMARY OF THE INVENTION

Accordingly, the instant invention provides a document feeding device, which comprises a hopper oriented at an acute angle with respect to a horizontal plane, said hopper having an upstream aperture and a downstream aperture and able to support a pack of documents to be fed therefrom, means situated at the lower end of the hopper for feeding documents seriatim from the hopper, and a first pulley whose outer surface extends slightly through said downstream aperture and a second pulley whose outer surface extends slightly through said upstream aperture. The document feeding device also comprises a double sided timing belt mounted on said first and second pulleys and riding on the upper surface of said hopper, a switch in contact with the lead document of said pack of documents, said switch having contacts which close when the angle of repose of said pack of documents relative to the hopper is sufficiently decreased, and a solenoid operatively connected to one of said pulleys and to said switch. When said contacts are closed, said solenoid is energized to index said one pulley, whereby said timing belt is indexed forward, thereby moving said pack of documents forward and maintaining said pack of documents at an optimum pack pressure and angle of repose for seriatim feeding.

DETAILED DESCRIPTION

Figure 2:
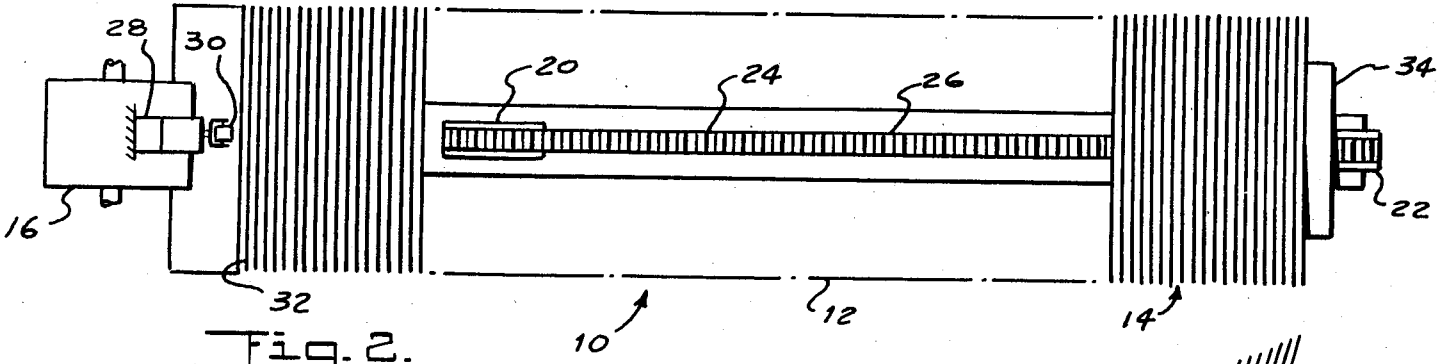
FIG. 2 is a schematic, top plan view of the document feeding device seen in FIG. 1.
Figure 1:
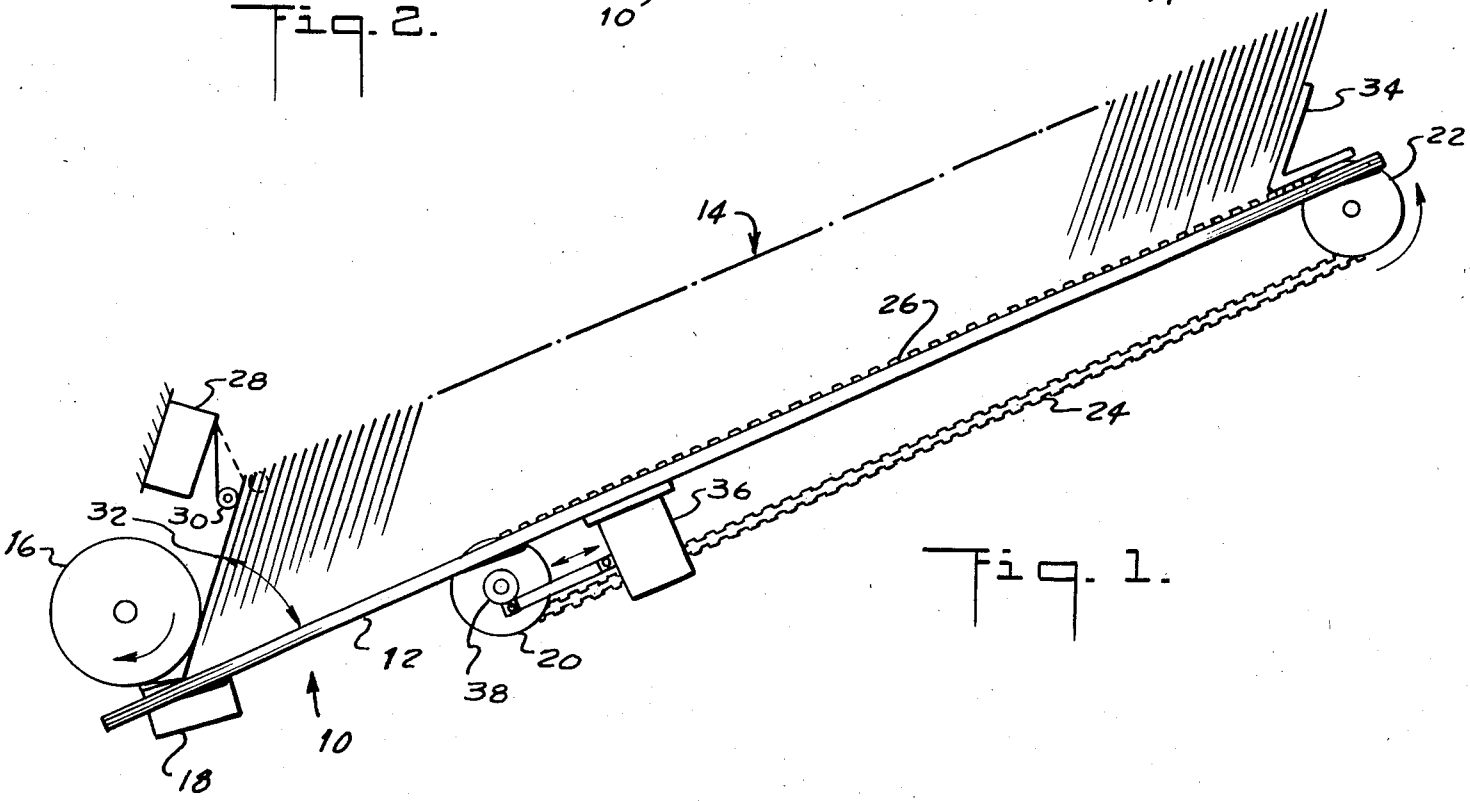
FIG. 1 is a schematic, side elevational view of a document feeding device in accordance with the instant invention.

In describing the preferred embodiment of the instant invention, reference is made to the drawings, wherein there is seen a feeder generally designated 10 which may be part of an inserting machine (not shown) which typically includes a series of feeders. The feeder 10 includes a hopper 12 oriented at an angle of about 26 degrees to the horizontal. The hopper 12 supports a pack of documents 14 which are fed seriatim therefrom by means of a separator roller 16 and a separator stone 18 located at the lower end of the hopper 12. A first pulley 20 extends slightly through a downstream aperture in the hopper 12 and a second pulley 22 extends slightly through an upstream aperture in the hopper 12. A double sided timing belt 24 is mounted on the two pulleys 20 and 22. The upper portion 26 of the double sided timing belt 24 rides on the upper surface of the hopper 12.

An electrical switch 28 includes an actuator 30 for sensing the lead document 32 in the pack of documents 14. The rear portion of the pack of documents 14 may be supported by a back prop 34, which rests on the double sided timing belt 24, but typically the feeder 10 is run without the back prop 34, as it is generally not necessary for maintaining adequate pack pressure and pack angle x. The back prop 34 is mounted in the teeth of the timing belt 24 and can be manually removed therefrom.

During the operation of the feeder 10, the feed angle x will gradually decrease. When the angle x decreases sufficiently, the switch 28 will close its contacts and thus energize a solenoid 36, which in turn cranks a one way polyclutch 38 counterclockwise. The double sided timing belt 24 is thereby indexed through the first pulley 20, which is operatively connected to the polyclutch 38. The back prop 34 is removably interlocked with the timing belt 24 and insures that the pack of documents 14 moves collectively. The indexing of the timing belt 24 moves the lead document 32 forward, which causes the switch actuator 30 to open the contacts of the switch 28, thereby terminating further indexing until the angle x decreases sufficiently again to close the contacts of the switch 28.

The amount of indexing of the timing belt 24 can be set as desired, preferably by adjusting the length of the stroke of the solenoid 36.

It can be seen from the foregoing description that the document feeding device 10 of the instant invention provides greater reliability in feeding, requires less attention from the operator of the feeder in the loading of the feeder, and affords increased production owing to fewer stoppages.

While a particular embodiment of the invention has been shown and described, it should be understood that the invention is not limited thereto since many modifications may be made. It is therefore contemplated to cover by the present application any and all such modifications as fall within the true spirit and scope of the appended claims.

What is claimed is:

1. A document feeding device, comprising:

a hopper oriented at an acute angle with respect to a horizontal plane, said hopper having a lower end, an upstream aperture and a downstream aperture and able to support a pack of documents to be fed therefrom;

means situated at the lower end of the hopper for feeding documents seriatim from the hopper;

a first pulley whose outer surface extends slightly through said downstream aperture and a second pulley whose outer surface extends slightly through said upstream aperture;

a double sided timing belt mounted on said first and second pulleys and riding on the upper surface of said hopper;

a switch in contact with the lead document of said pack of documents, said switch having contacts which close when the angle of repose of said pack of documents relative to the hopper is sufficiently decreased; and a solenoid operatively connected to one of said pulleys and to said switch, wherein when said contacts are closed, said solenoid is energized to index said one pulley, whereby said timing belt is indexed forward, thereby moving said pack of documents forward and maintaining said pack of documents at an optimum pack pressure and angle of repose for seriatim feeding.

2. The document feeding device of claim 1, wherein the feeding means comprises a separator roller and a separator stone.

3. The document feeding device of claim 1, wherein the hopper is oriented at an angle of about 26 degrees.

4. The document feeding device of claim 1, wherein said switch includes an actuator in contact with the lead document of said pack of documents.

5. The document feeding device of claim 4, additionally comprising a back prop removably mounted on the double sided timing belt for supporting the rear portion of the pack of documents.

* * * * *